United States Patent [19]

Wandel et al.

[11] Patent Number: 4,974,586

[45] Date of Patent: Dec. 4, 1990

[54] BREATHING MASK

[75] Inventors: Heinz Wandel; Martin Skov, both of Walddorfhaslach, Fed. Rep. of Germany

[73] Assignee: Moldex/Metric Products, Inc., Culver City, Calif.

[21] Appl. No.: 254,205

[22] Filed: Oct. 6, 1988

[30] Foreign Application Priority Data

Oct. 7, 1987 [EP] European Pat. Off. ..... 87114646

[51] Int. Cl.[5] ..... A62B 18/02; A62B 18/10

[52] U.S. Cl. ..... 128/206.28; 128/207.12; 128/206.22

[58] Field of Search ..... 128/205.27, 205.29, 128/206.12, 206.15, 206.19, 206.21, 206.22, 206.27, 206.28, 207.12, 201.15, 201.19

[56] References Cited

U.S. PATENT DOCUMENTS

| | | | |
|---|---|---|---|
| 1,268,696 | 6/1918 | Donald | 128/206.21 |
| 1,359,631 | 11/1920 | Teed | 128/207.12 |
| 1,975,797 | 10/1934 | Montuori | 128/205.27 |
| 2,005,072 | 6/1935 | Booharin | 128/206.22 |
| 2,008,677 | 7/1935 | Booharin | 128/206.15 |
| 2,029,129 | 1/1936 | Schwartz | 128/206.15 |
| 2,070,241 | 2/1937 | Schwartz | 128/206.15 |
| 2,102,037 | 12/1937 | Schwartz | 128/206.15 |
| 2,108,256 | 2/1938 | Dym | 128/201.19 |
| 2,112,213 | 3/1938 | Schwartz | 128/206.15 |
| 2,114,358 | 4/1938 | Schwartz | 128/206.15 |
| 2,160,317 | 5/1939 | Schwartz | 128/206.15 |
| 2,164,330 | 7/1939 | Katz et al. | 128/207.12 |
| 2,181,026 | 11/1939 | Schwartz | 128/206.15 |
| 2,238,964 | 4/1941 | Benos | 128/206.15 |
| 2,295,296 | 9/1942 | Schmidt | 128/206.15 |
| 2,304,798 | 12/1942 | Comstock | 128/206.22 |
| 2,359,506 | 10/1944 | Battley et al. | 128/201.15 |
| 2,381,568 | 8/1945 | Booharin | 128/207.12 |
| 2,893,387 | 7/1959 | Gongoll et al. | 128/206.15 |
| 3,474,783 | 10/1969 | Ulmann | 128/206.15 |

FOREIGN PATENT DOCUMENTS

| | | | |
|---|---|---|---|
| 0267428 | 5/1988 | European Pat. Off. | 128/205.13 |
| 1213251 | 3/1966 | Fed. Rep. of Germany | 128/206.15 |
| 6701157 | 8/1967 | Netherlands | 128/207.12 |
| 438863 | 11/1935 | United Kingdom | 128/206.19 |
| 8302726 | 8/1983 | World Int. Prop. O. | 128/205.29 |

*Primary Examiner*—Edgar S. Burr
*Assistant Examiner*—Kimberly L. Asher
*Attorney, Agent, or Firm*—Charles H. Schwartz; Ellsworth R. Roston

[57] ABSTRACT

A breathing mask is provided which comprises an exhaling valve disposed in an opening of the breathing mask wall. The exhaling valve includes a thin diaphragm which is adapted to be moved by the breathing pressure during inhaling and exhaling either towards or away from a sealing seat. To provide a less expensive breathing mask whose exhaling valve safely closes in particular in dust-particle-containing air and which nevertheless involves low opening and closing pressures, the diaphragm is provided with an arch. Air is allowed to escape over only a part of the circumference of the diaphragm, while the remaining part of the diaphragm circumference is so connected to a base member that the arching direction of the arch is at least partly reversible by the breathing pressure.

14 Claims, 2 Drawing Sheets

FIG. 2
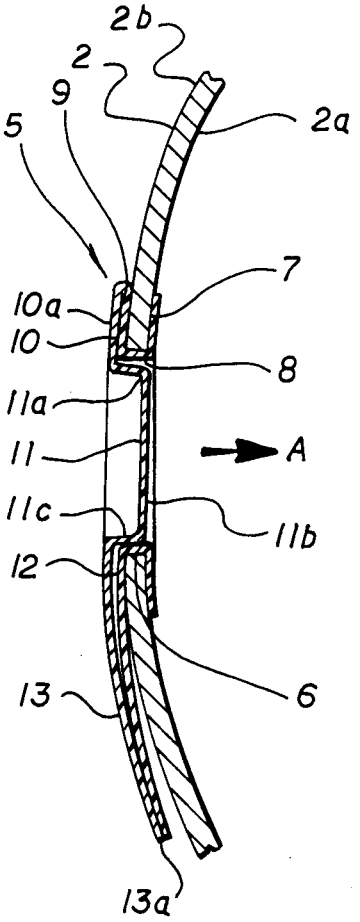
FIG. 3
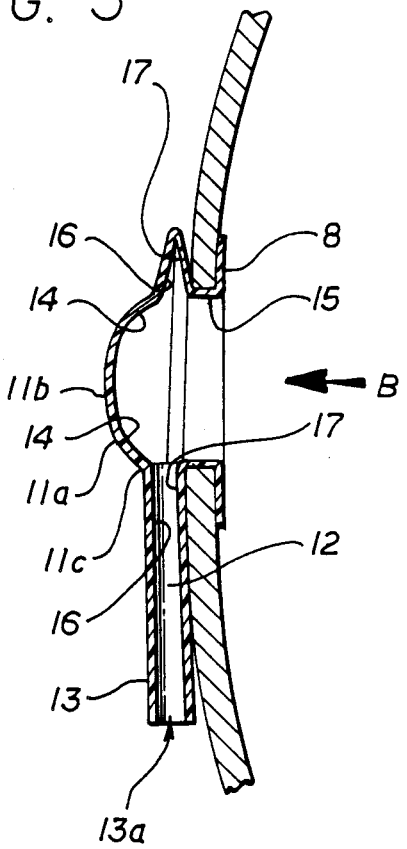
FIG. 4
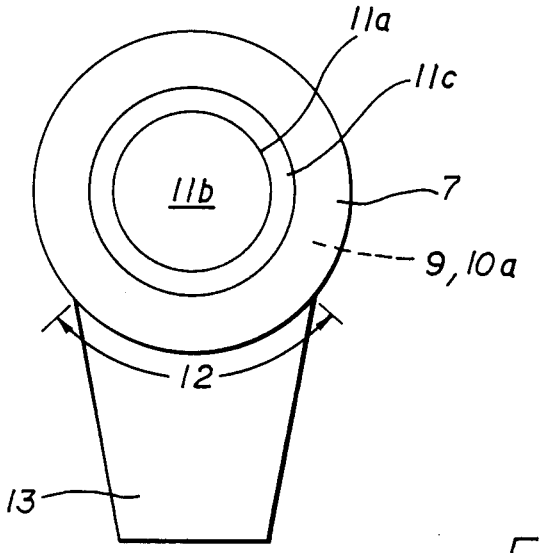
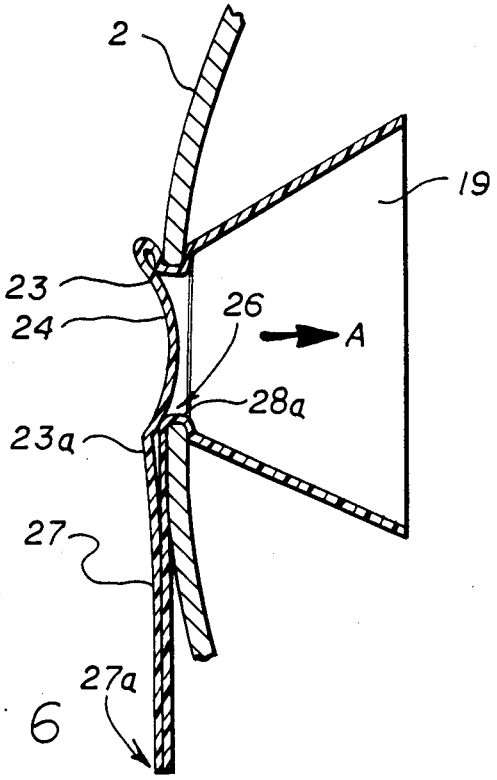
FIG. 6

BREATHING MASK

BACKGROUND OF THE INVENTION

1. Field of the Invention

This invention relates to a breathing mask having an exhalation valve which is disposed in an opening of the mask wall and includes an outlet for the breathing air which is positioned at the circumference of a thin diaphragm, during inhaling the diaphragm being pulled onto a sealing seat to close the outlet and during exhaling the diaphragm being lifted off the sealing seat to open the outlet.

A breathing mask of this type is known. The prior known mask has an exhalation valve which is inserted into a mask wall opening in the form of a capsule. The capsule includes two annular flanges between which the wall is clamped. In one embodiment, the inner opening of the annular flanges is traversed by reinforcement ribs disposed in star-shaped fashion, on the center of which a circular diaphragm blade is fastened to the outer side of the mask. The diaphragm blade is made of a thin, flexible material and has a diameter which is somewhat greater than the inner diameter of the annular flanges, so that the outer circumference of the diaphragm blade still rests on the outwardly directed surface of the outer flange. At the point where the diaphragm blade rests on the flange, a sealing seat is provided in the form of an annular web having a cross-section which is tapered like a knife in direction towards the diaphragm blade. During exhaling the exhaling air presses from the interior against the diaphragm blade in the areas between the reinforcement ribs and lifts the circumference of the diaphragm blade off from its abutment at the sealing seat, so that the exhaling air is allowed to escape at the outer circumference of the diaphragm blade. During inhaling, on the other hand, the diaphragm blade is pulled into abutment with the sealing as an effect of the vacuum produced The known exhalation valve, however, is relatively complex due to the plurality of parts which must be produced separately, and assembled. Exhalation valves generally have to open at a relatively low exhaling pressure as their arrangement would be otherwise useless. Consequently, the diaphragm blade of the prior known breathing mask has to be of comparatively thin and light-weight construction to in fact give breathing relief to the person wearing the mask. This means, however, that there is also the risk of malfunction due to diaphragm blades being not exactly flat. For instance, the diaphragm blade freely accessible towards the exterior may be creased by any unintended handling error, so that it can no longer be pulled onto the sealing seat in flat fashion. Furthermore, the diaphragm blade only rests on the comparatively narrow, knifeshaped surface of the sealing seat. Whenever a particle of dust is deposited on this surface, a gap will remain through which unfiltered air is allowed to enter the interior of the breathing mask.

Consequently, the present invention is based on the task of providing a breathing mask having an exhalation valve which opens at a sufficiently low breathing pressure and nevertheless closes safely and reliably during inhaling, and production and assembly of which moreover involves only minor costs.

SUMMARY OF THE INVENTION

In accordance with the invention a breathing mask is provided comprising a filter wall being permeable to air in both inhaling and exhaling directions, said filter wall having an inner face side and an outer side and containing an opening therein, an exhalation valve being sealingly disposed within said opening, said exhalation valve having an inlet which opens toward said face side and an outlet which is disposed at the outer side of the side wall, said exhalation valve further comprising a base member and a thin flexible diaphragm, said diaphragm extending essentially across said exhaling and inhaling direction and being connected to said base member over a first part of its circumference while the remaining part of its circumference forms said outlet of said exhalation valve, a sealing seat being provided at least adjacent to said outlet, said diaphragm preferably in a rest position forming an arch in the inhaling direction, while during inhaling said diaphragm being pulled by the breathing pressure towards said sealing seat to close said outlet, and during exhaling being lifted off said sealing seat by the breathing pressure to open said outlet and with the arching direction of said arch being at least partly reversable by the breathing pressure.

As the outlet is reduced in size it is much easier to protect the latter against the penetration of dust. Inspite of this reduction in size the outlet is still capable of opening with a sufficient cross-section as the opening movement of the outlet during exhaling is supported by the reversing of the diaphragm arch. During inhaling, on the other hand the arch is pulled into the opening of the breathing mask wall so that a reliable sealing effect is achieved. The arch is preferably directed inwards from the very beginning i.e. also in a rest position without breathing pressure, so that optimum sealing is achieved during inhaling.

The structural design according to the invention further allows the provision of sealing surfaces which abut against one another during inhaling.

In this context one of the sealing surfaces may be disposed on a bead-like thickening so that the diaphragm pulled into the interior of the opening during inhaling contacts the sealing seat without a sharp crease.

When the circumferential area of the arch corresponds substantially to the circumference of the opening in the wall of the breathing mask, at least the circumferential area of the arch is available as sealing surface.

When the arch is smaller than the diaphragm and disposed in the center thereof, the opening movement is facilitated for the outlet during exhaling without sealing problems arising during inhaling, it being possible to accommodate an additional sealing surface.

The arch may be obtained in a particularly simple and less expensive manner by impressing the diaphragm material, which moreover has the advantage that the arch can be produced accurately to dimension, whereby the sealing effect is further improved.

The production of the exhalation valve used in the breathing mask according to the invention will be particularly simple and less expensive if the relevant parts are formed in one piece of a thin, flexible material.

The additional use of a duck valve further enhances the sealing effect, though practical tests have shown that the required legal limits can be also attained without the duck valve.

The duck valve is suitably also formed integrally with the other parts of the exhalation valve.

In addition the wall thickness of the duck valve may be reduced in the lip area, so that the opening and closing resistances of the duck valve can be reduced to facilitate breathing.

The exhalation valve can be connected to the breathing mask in a particularly simple and less expensive manner by buttoning into the opening of the breathing mask wall.

When a collecting chamber is arranged in the interior of the breathing mask, breathing air can be collected and purposefully directed to the exhalation valve, whereby valve opening is facilitated.

The invention can be used for any type of breathing mask. It will be particularly advantageous, however, if the breathing mask is of the half-mask type having a filtering wall. This type of mask is employed in dust laden air, wearing time of the mask, however, being limtied (to approx. 8 hours) Afterwards the mask is thrown away. Disposable masks according to their nature, however, have to be relatively inexpensive.

Moreover, the wearer should not be hampered or irritated by such mask in cases where the wearer has to perform physical work. Exhalation valves are a great help in this case provided that the pressure necessary to open the exhalation valve is now enough to permit the greatest part of exhaled air to escape through the valve instead of being pressed through the filter wall. Another problem results from the humidity of the exhaling air. It has to be ensured that as much humid air as possible is directed through the valve to largely prevent the filter wall from being humidified. These requirements are satisfied by the exhalation valve used according to the present invention.

BRIEF DESCRIPTION OF THE DRAWINGS

An embodiment of the present invention shall hereinafter be described with reference to the drawings, wherein:

FIG. 2 shows th section II—II of FIG. 1 for a preferred embodiment of the invention;

FIG. 3 is a representation according to FIG. 2 during exhaling;

FIG. 4 is a side view of FIG. 2 and FIG. 3;

FIG. 6 is a representation according to FIG. 5 during inhaling; and

DETAILED DESCRIPTION

Figure 1:
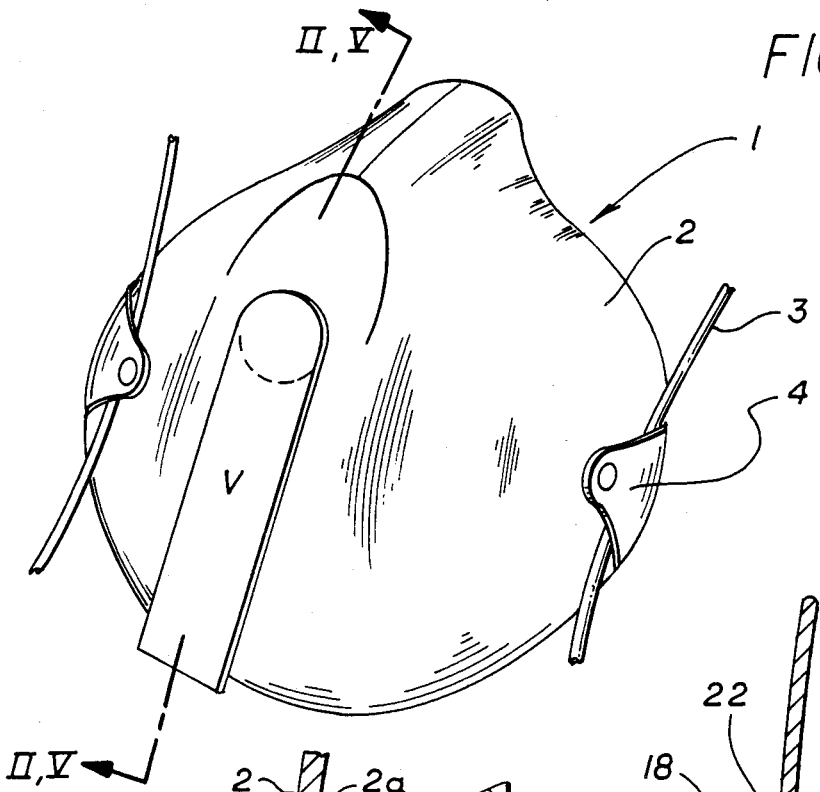
FIG. 1 shows a perspective view of a breathing mask according to the present invention.

FIG. 1 shows in perspective a breathing mask formed as filtering half-mask 1. Half-mask 1 is brought into a form adapted to the form of the face of a normal wearer and consists of a filter wall 2 which is pervious in both directions to breathing air, but filters off pollutants. Half-mask 1 must be worn over mouth and nose with the aid of a strap means 3 extending around the back of the head. Flaps 4 are used for arranging the strap means 3 at the half-mask. In the area of the mouth of the wearer an exhalation valve V, which is only diagrammatically shown in FIG. 1, is disposed within an opening of filter wall 2, the opening being described in more detail as the description proceeds.

A first embodiment 5 of said exhalation valve V is represented in more detail in FIG. 2. Exhalation valve 5 is made in one piece of a thin, flexible material, for example rubber, plastic material or the like. Exhalation valve 5 extends through an opening 6 which is recessed in filter wall 2. On the inner side 2*a* of filter wall 2 facing the wearer the exhaling valve has an annular flange 7 connected i.e. either welded or bonded to the inner side of filter wall 2. Next to the annular flange 7 is an intermediary 8 lapping over the circumference of opening 6. Next to intermediary 8 is a base member 9 which extends substantially parallel to flange 7 on the outer side 2*b* of filter wall 2 and contacts the latter without being connected thereto. Next to base member 9 and opposing the latter is an annular section 10*a* of a diaphragm 10 which in the region opposing opening 6 is provided with an arch 11 projecting into said opening 6. Arch 11 is obtained by impressing diaphragm 10 so that an annular edge 11*a* results which is dimensionally comparatively stable and separates a covering section 11*b* from a circumferential section 11*c* of arch 11. The diameter of the annular edge and thus the diameter of the covering section 11*b* is adapted to the diameter of said opening 6 reduced by the thickness of intermediaries 8 so that covering section 11*b* substantially spans opening 6. The length of the circumferential section 11*c* is so dimensioned, that the covering section 11*b* substantially terminates at the inner side 2*a* of filter wall 2.

The connection between the annular section 10*a* of diaphragm 10 and base member 9 is interrupted at a point directing downwards when half-mask 1 is worn to define an outlet 12 (FIG. 4). Outlet 12 extends over about one quarter of the circumference of the base member and annular section 10*a*, respectively, whereas three quarters of this circumference are hermetically connected.

Next to outlet 12 is a duck valve 13. Duck valve 13 is integrally formed with the parts of the exhalation valve 5 described hereinbefore. Duck valve 13 consists in a manner known per se of a hose-like piece of material which is flattened in such manner that the wall areas of the hose piece are in plane contact with respect to one another. Duck valve 13 opens during blowing and closes during sucking. The wall thickness of duck valve 13 may be reduced between outlet 12 and an outlet 13*a* of duck valve 13, so that the required opening and closing pressures can be further reduced.

As shown in FIG. 2, arch 11 of exhalation valve 5 is so designed that when in a rest position where neither an inhaling nor an exhaling pressure is applied, the arch 11 projects into opening 6 after valve 5 has been inserted into opening 6 of filter wall 2. Inhaling in the direction of arrow A then results in the covering section 11*b* being pulled farther into opening 6 as an effect of the produced vacuum, with the surface 14 of circumferential section 11*c* of arch 11 (for the sake of clarity only shown in FIG. 3) firmly abutting against the surface 15 of intermediary 8 which forms a sealing seat. Furthermore, the surface 16 of annular section 10*a* of diaphragm 10 abuts against the surface 17 of base member 9. Consequently, relatively large first sealing surfaces 15 and 17 are available for the sealing seat, said sealing surfaces being opposed by second sealing surfaces 14, 16 which are identical in size. If outlet 12 nevertheless is not yet sealed and vacuum is also applied in the area of duck valve 13, the wall areas of the latter will be also squeezed, so that no air is allowed to pass by the exhalation valve during inhaling in the direction of arrow A.

During exhaling in the direction of arrow B in FIG. 3 exhaling pressure is again applied to the section 11b of arch 11 and lifts diaphragm 10 off the sealing seat 15, 17. Outlet 12 and duck valve 13 are thus already caused to open to a certain extent Depending on the strength of the breathing pressure the arching direction of arch 11 moreover more or less changes, so that either a part or the entire circumferential section 11c of arch 11 now faces away from opening 6. As diaphragm and base member, however, are interconnected over most of the circumferences a certain dimensional stability is attained by this reversing step which during exhaling facilitates the opening of the outlet and keeping the latter open. Inhaling again in the direction of arrow A in FIG. 2, on the other hand, causes arch 11 to direct inwards again, so that a considerably fast and effective closure of outlet 12 is achieved.

Figure 5:
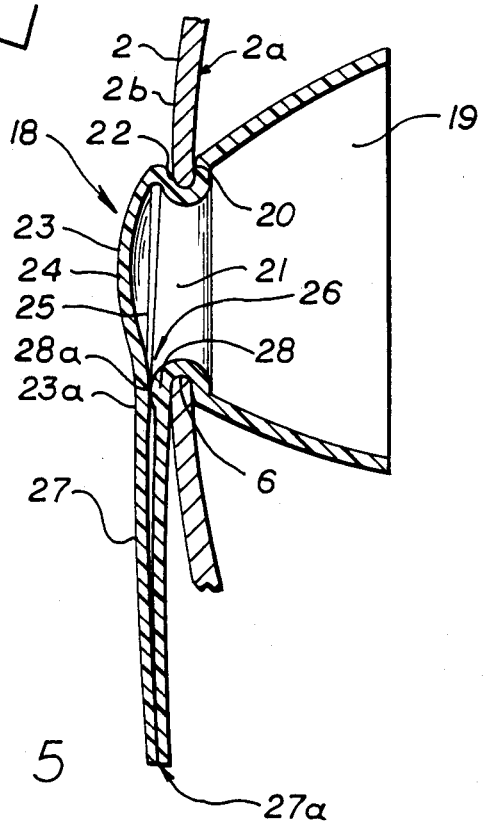
FIG. 5 shows the section V—V of FIG. 1 for a second mask.

FIG. 5 shows a further embodiment 18 of an exhalation valve V which may replace the exhalation valve 5 used in the mask according to FIG. 2. Exhalation valve 18 is again made in one piece of a thin, flexible material such as, for example, rubber or plastic material, or the like. Exhalation valve 18 includes a funnel-shaped collecting chamber 19 which extends beyond the inner side 2a of filter wall 2, is disposed in the area of the wearer's mouth and nose and is used for collecting and conducting exhaled air. An annular flange section 20 of the funnel-shaped collecting chamber 19 is in engagement with the inner side 2a of filter wall 2. Filter wall 2 is again provided with an opening 6 through which an intermediary 21 extends. A base member 22 which opposes said annular flange 20 is in engagement with the outer side 2b. Connected to base member 22 is a diaphragm 23 which has an arch 24 substantially comprising all of the diaphragm 23. In rest position i.e. when no breathing pressure is applied, arch 24 is curved outwards and forms a cupola-shaped collecting chamber 25. At the point directing downwards when the mask is worn, base member 22 and diaphragm 23 are not connected and define an outlet 26 which is designed and dimensioned analogously to outlet 12. Next to outlet 26 is a duck valve 27 having an outlet 27a of its own, the form of said duck valve being analogous to the form of duck valve 13. In the area of outlet 26 base ember 22 is provided with a bead-like thickening 28 which projects in a direction towards the diaphragm 23 and has a surface 28a which forms the sealing seat for the surface 23a of diaphragm 23 opposing the bead-like thickening 28.

As shown in FIG. 6 during inhaling in the direction of arrow A arch 24 of diaphragm 23 is pulled into opening 6 by reversing the arching direction of arch 24. Sealing surface 23a of diaphragm 23 is thus placed over sealing surface 28a of the bead-like thickening 28, so that outlet 26 is closed. The produced vacuum at the same time effects the closure of outlet 27a of duck valve 27, so that the valve is tight.

During exhaling, which is not shown, exhaling air is collected in collecting funnel 19 and directed into the cupola-shaped collecting chamber 25. The so achieved concentration of the exhaling pressure effects the outwards arching of diaphragm 23 whereby the outlet 26 and afterwards duck valve 27 open.

Figure 7:
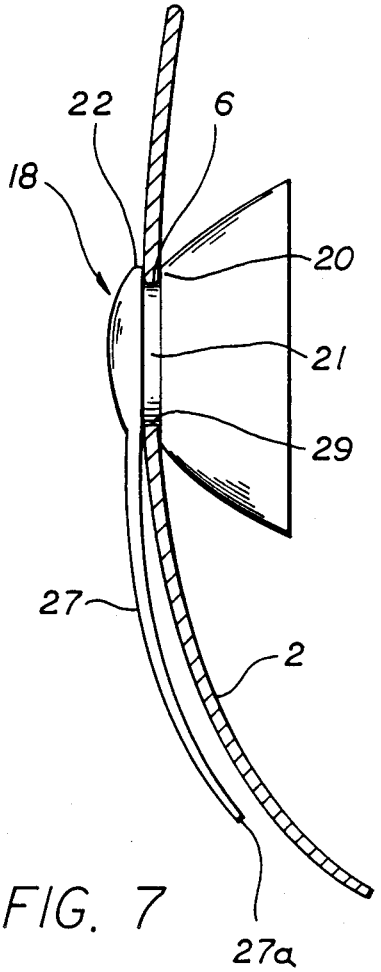
FIG. 7 is a representation of the connection exhalation valve breathing mask.

FIG. 7 shows buttoning of the exhalation valve 18 into the opening 6 of filter wall 2. Annular flange 20 intermediary 21, and base member 22 define an annular constriction 29 whose outer diameter corresponds to the inner diameter of opening 6 in filter wall 2. Exhalation valve 18 is thus safely held within opening 6. During exhaling breathing pressure is applied to the wall of the funnel-shaped collecting chamber 19, said wall expanding and introducing radial traction forces into annular flange 20 which strive to pull intermediary 21 towards the circumference of opening 6. At the same time, however, breathing pressure is also applied to the inwardly directed side of annular flange 20, so that the latter is pressed against the inner side 2a of filter wall 2. During inhaling the inwards arched diaphragm 23 forces base member 22 against the outer side 2b of filter wall 2. Opening 6 is in this way sealed against penetrating pollutant laden air. The exhalation valve, however, may be also bonded to the mask.

As is further shown in FIG. 7, it is suitable to bend duck valve 27 in such a manner that the latter substantially follows the contour of filter wall 2 so that outlet 27a of duck valve 27 does not directly face downwards. Exhaling air is so prevented from being directly blown to a possible working place.

Duck valve 13 may be bent in analogous manner. Furthermore, it is not necessary that the outlets 12, 26 and the lip valves 13 and 27, respectively, are designed to direct downwards. On the contrary, these parts may also be designed to direct either sidewards or upwards so that exhaling air can be directed towards any desired direction.

Exhalation valves V are produced in one piece by immersing a corresponding positive mold in a bath of material employed. If a wall thickness is desired in the area outside the duck valve which is somewhat greater than the wall thickness in the lip area, a two- or multistage immersing process proved suitable, in which those parts where a greater wall thickness is desired are dipped into the bath a corresponding number of times more often In accordance with the material parameters the wall thickness can be adapted to match the required opening- and closing pressures which result from the required sealing effect. For an exhalation valve according to FIGS. 5 and 6 wall thicknesses of 0.3 mm in the vicinity of the outlet of the duck valve have proved excellent, whereas the remaining parts have been provided with a wall thickness of about 0.8 mm.

Modifying the described and drawn embodiments, for example, particularly the embodiment according to the FIGS. 2 and 3, the duck valve can be completely omitted, or it can be reduced in length.

It is further possible, particularly in the embodiment according to the FIGS. 2 and 3, to replace the single outlet by a plurality of outlets which are distributed over the diaphragm circumference, it being necessary, however to design the area where the diaphragm is connected to the base member in such a manner that the arching direction is enabled to reverse.

Furthermore, it is also possible to interchange the details and parts shown and described with regard to the individual embodiments so that, for example, the exhalation valve represented in the FIGS. 5 and 6 can be formed without a collecting chamber. It is moreover possible to use the exhalation valves in any type of mask where a separate exhaling valve is required or desired.

We claim:

1. A breathing mask comprising a filter wall being permeable to air in both inhaling and exhaling directions, said filter wall having an inner face side and an outer side and containing an opening therein, and an exhalation valve being sealingly disposed within said opening, said exhalation valve having an inlet which opens toward said face inside and an outlet which is disposed at the outer side of said wall, said exhalation valve further comprising a base member extending through said opening and having a reduced diameter portion clampingly engaged with said opening for buttoning said valve into said wall, and a thin flexible diaphragm integrally formed with said base member, and adapted to be moved by pressure applied thereon during inhaling and exhaling, said diaphragm covering said opening at said outer side by extending essentially across said exhaling and inhaling direction, in said diaphragm being connected to said base member over a first part of a circumferential line of said diaphragm while a second part of said circumferential line remains unconnected to said base member thus forming said outlet of said exhalation valve, said diaphragm having a portion of a concave curvature of greater than zero degrees extending into said opening when said diaphragm is in a rest position with no pressure of exhaling applied thereto, while, under pressure of exhaling, said portion of said diaphragm at least partially has a convex curvature, said diaphragm having a sealing surface facing a corresponding sealing surface arranged at said base member adjacent said opening, said sealing surfaces being adapted to be pressed into sealing contact by pressure of inhaling.

2. A breathing mask according to claim 1,
characterized in that said portion of curvature of said diaphragm corresponds in size to said opening.

3. A breathing mask according to claim 1,
characterized in that said portion of curvature is arranged substantially in the center of said diaphragm and is smaller than said diaphragm.

4. A breathing mask according to claim 1,
characterized in that said portion of curvature is formed by impressing said diaphragm.

5. A breathing mask according to claim 1, characterized in that a duck valve is provided next to said outlet.

6. A breathing mask according to claim 5,
characterized in that said duck valve is formed integrally with said diaphragm and said base member.

7. A breathing mask according to claim 5, characterized in that the wall thickness of said duck valve is smaller than the remaining wall thickness of the exhalation valve.

8. A breathing mask according to claim 1 formed as a semi-mask having a filtered wall.

9. A breathing mask comprising a filter wall being permeable to air in both inhaling and exhaling directions, said filter wall having an inner face side and an outer side and containing an opening therein, and an exhalation valve being sealingly disposed within said opening, said exhalation valve having an inlet which opens toward said face side and an outlet which is disposed at the outer side of said wall, said exhalation valve further comprising a base member extending through said opening and having a reduced diameter portion clampingly engaged with said opening for buttoning said valve into said wall and a thin flexible diaphragm integrally formed with said base member, and adapted to be moved by pressure applied thereon during inhaling and exhaling, said diaphragm covering said opening at said outer side by extending essentially across said exhaling and inhaling direction, said diaphragm being connected to said base member over a first part of a circumferential line of said diaphragm while a second part of said circumferential line remains unconnected to said base member thus forming said outlet of said exhalation valve, said diaphragm having a portion of a convex curvature of greater than zero degrees extending away from said opening when said diaphragm is in a rest position with no pressure of inhaling applied thereto, while, under pressure of inhaling, said portion of said diaphragm at least partially has a concave curvature, said diaphragm having a sealing surface facing a thickened portion of said base member arranged adjacent said outlet formed by said unconnected second part of said circumferential line, said sealing surface and said thickened portion being adapted to be pressed into sealing contact by pressure of inhaling.

10. A breathing mask according to claim 9,
characterized in that said portion of curvature is formed by impressing said diaphragm.

11. A breathing mask according to claim 9,
characterized in that a duck valve is provided next to said outlet.

12. A breathing mask according to claim 9,
characterized in that said duck valve is formed integrally with said diaphragm and said base member.

13. A breathing mask according to claim 9,
characterized in that the wall thickness of said duck valve is smaller than the remaining wall thickness of the exhalation valve.

14. A breathing mask according to claim 9,
characterized in that a funnel-shaped collecting chamber for the exhaling air is provided in the interior of the mask.

* * * * *